US005620950A

United States Patent [19]

Kamakura et al.

[11] Patent Number: 5,620,950

[45] Date of Patent: Apr. 15, 1997

[54] LUBRICATED REFRIGERANT COMPOSITION CONTAINING ALICYCLIC EPOXY COMPOUNDS

[75] Inventors: Tamiji Kamakura; Noriyoshi Tanaka; Kimiyoshi Namiwa; Yukio Tatsumi; Masato Namiki, all of Tokyo, Japan

[73] Assignee: Asahi Denka Kogyo K.K., Tokyo, Japan

[21] Appl. No.: 512,747

[22] Filed: Aug. 8, 1995

Related U.S. Application Data

[63] Continuation of Ser. No. 959,962, Oct. 13, 1992, abandoned.

[30] Foreign Application Priority Data

Oct. 15, 1991 [JP] Japan ..... 3-266448

[51] Int. Cl.[6] ..... C09K 5/00; C10M 105/38

[52] U.S. Cl. ..... 508/485; 508/492; 508/495; 508/493; 508/494; 508/496; 252/68

[58] Field of Search ..... 252/52 A, 52 R, 252/68, 56 R; 508/485, 492, 495, 493, 494, 496

[56] References Cited

U.S. PATENT DOCUMENTS

| | | | |
|---|---|---|---|
| 2,552,084 | 5/1951 | Bishop et al. | 252/68 |
| 3,941,708 | 3/1976 | Gentit et al. | 252/78 |
| 3,976,585 | 8/1976 | Herber et al. . | |
| 4,248,726 | 2/1981 | Uchinuma et al. | 508/304 |
| 4,267,064 | 5/1981 | Sasaki et al. | 508/304 |
| 4,454,052 | 6/1984 | Shoji et al. | 252/68 |
| 4,755,316 | 7/1988 | Magid et al. | 252/68 |
| 5,032,305 | 7/1991 | Kamakura | 252/67 |
| 5,096,606 | 3/1992 | Hagihara | 252/68 |
| 5,108,634 | 4/1992 | Seiki . | |
| 5,417,872 | 5/1995 | Fukuda et al. | 252/68 |
| 5,443,745 | 8/1995 | Sakamoto et al. | 508/304 |
| 5,445,753 | 8/1995 | Fukuda et al. | 508/304 |
| 5,454,963 | 10/1995 | Kaneko | 508/304 |

FOREIGN PATENT DOCUMENTS

| | | |
|---|---|---|
| 0435253A1 | 12/1990 | European Pat. Off. . |
| 0448402A2 | 3/1991 | European Pat. Off. . |
| 430657 | 6/1991 | European Pat. Off. . |
| 0496937A1 | 9/1991 | European Pat. Off. . |
| 0475751A1 | 9/1991 | European Pat. Off. . |
| 0501440A1 | 2/1992 | European Pat. Off. . |
| 2260616 | 9/1975 | France . |
| 2265851 | 10/1975 | France . |
| 57063395 | 4/1982 | Japan . |
| 3-7798 | 1/1991 | Japan . |
| 3-28296 | 2/1991 | Japan . |
| 3-88892 | 4/1991 | Japan . |
| 3-128992 | 5/1991 | Japan . |
| 3-128991 | 5/1991 | Japan . |
| 3275799 | 12/1991 | Japan . |
| 4-55498 | 2/1992 | Japan . |
| 8907129 | 8/1989 | WIPO . |

*Primary Examiner*—Alan D. Diamond
*Attorney, Agent, or Firm*—Olson & Hierl, Ltd.

[57] ABSTRACT

The objective of the present invention resides in providing a lubricant for refrigerators that reacts rapidly with free acids and contains a stabilizer that has good compatibility with a chlorine-free Flon-thpe coolant such as Flon 134a and the like whose molecules do not contain chlorine. The lubricant for refrigerators employing a chlorine-free Flon-type coolant in accordance with the present invention 100 parts by weight of a synthetic oil and is compounded with 0.05 to 15 parts by weight of an alicyclic epoxy compound having one or more functional groups represented by the following formula:

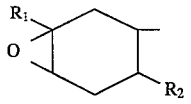

(1)

(wherein $R_1$ and $R_2$ independently represent a hydrogen or methyl group, and may be the same or different).

7 Claims, No Drawings

LUBRICATED REFRIGERANT COMPOSITION CONTAINING ALICYCLIC EPOXY COMPOUNDS

This is a application continuation of Ser. No. 07/959,962 filed Oct. 13, 1993, now abandoned.

BACKGROUND OF THE INVENTION i) Field of the Invention

The present invention relates to a lubricant for refrigerator. More specifically, the present invention relates to a lubricant for refrigerators (including air conditioners) employing a chlorine-free Flon-type coolant such as Flon 134a (1,1,1,2-tetrafluoroethane), Flon 32 (difluoromethane), Flon 125 (1,1,1,2,2pentafluoroethane), Flon 143a (1,1,1-trifluoroethane), Flon 152a (1,1difluoroethane), Flon 134 (1,1,2,2-tetrafluoroethane) and the like, and a composition for refrigerators using said lubricant.

ii) Description of the Related Art

Flon-type coolants have conventionally been excellent for use as a coolant for refrigerators as they are chemically stable and have low toxicity. However, the recent Montreal Protocol decided that the use of chlorofluorocarbons, for example Flon 12 (dichlorodifluoromethane), among these Flon-type coolants shall be totally abolished by the year 2000, because chlorofluorocarbons is a cause of damage to the ozone layer in the stratosphere and contributes to global warming.

In such circumstances, Flon-type coolants not having chlorine in the molecules thereof, i.e. chlorine-free Flon-type coolants have been developed and are representatively illustrated by Flon 134a as an alternative to Flon 12.

However, because of the higher polarity thereof, these chlorine-free Flon-type coolants without chlorine in molecules thereof, such as Flon 134a and the like, have poor compatibility with naphthene mineral oils, alkylbenzene and the like which have been employed as lubricants for refrigerators. In order to improve the compatibility, therefore, polyalkylene glycol lubricants for refrigerators have been proposed as used in the Specification of U.S. Pat. No. 4,755,316, Japanese Patent Laid-Open No.3-28296 and like, while ester lubricants for refrigerators have been proposed as disclosed in Japanese Patent Laid-Open Nos.2-268068, 3-88892, 3-128991, 3-128992 and the like.

On the other hand, trace amounts of water and oxygen are present in refrigerator compressors, and the polyalkylene glycol refrigerator oils if used as a libricant are oxidized and deteriorated, resulting in a tendency for the acid value to increase; ester refrigerator oils if used as a lubricant are hydrolyzed to generate free acids and as such, they are not very practicable.

In order to improve the stability of the lubricants, Japanese Patent Application Nos.2-73649 and 2-64431 have proposed the use of glycidyl ether-type epoxy compounds which have good compatibility with Flon 134a and the like as a stabilizer.

However, these glycidyl ether-type epoxy compounds not only have such drawbacks that the products thereof inevitably involve chlorine residue which is not preferable environmentally, but the compounds are also so slow in the reaction with free acids and the like that the corrosive action of the free acids is not sufficiently suppressed.

Therefore, it is an object of the present invention to provide a lubricant for refrigerators, containing a stabilizer capable of reacting rapidly with free acids and having good compatibility with chlorine-free Flon-type coolants, such as Flon 134a.

SUMMARY OF THE INVENTION

The present inventors, as a result of having made various studies regarding lubricants for air conditioners employing chlorine-free Flon-type coolants, have achieved the present invention.

According to the present invention, there is provided a lubricant for refrigerators employing a chlorine-free Flon-type coolant whose molecules do not contain chlorine characterized in that said lubricant contains 100 parts by weight of a synthetic oil and 0.05 to 15 parts by weight of an alicyclic epoxy compound having one or more functional groups represented by the following formula:

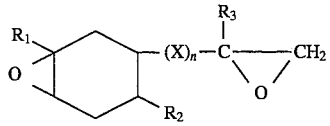

(1)

wherein R, $R_2$ and $R_3$ each independently represent a hydrogen or methyl group, and may be the same or different.

X represents $—CH_2—$, $—CH_2CH_2—$, or $—CH(CH_3)—$;

n represents the integer 0 or 1.

Further, according to the present invention, there is provided a composition for refrigerators characterized in that said composition contains a lubricant containing 100 parts by weight of a synthetic oil and 0.05 to 15 parts by weight of an alicyclic epoxy compound of formula (1) above and a chlorine-free Flon-type coolant whose molecules do not contain chlorine, at a ratio of from 1:99 to 99:1.

GENERAL DESCRIPTION OF THE INVENTION

The alicyclic epoxy compound to be used in the present invention may have functional groups represented by the above formula (1) within the molecule thereof.

In terms of compatibility with Flon 134a and the like, specifically preferable alicyclic epoxy compounds to be used in the present invention are those with the carbon number of the residue being 2 to 6 among the residues of the functional group represented by the formula (1). Furthermore in terms of the reactivity of free acids, the most preferable among these compounds are those shown as follows:

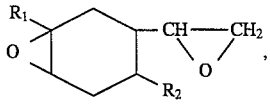

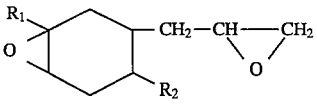

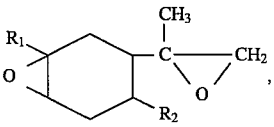

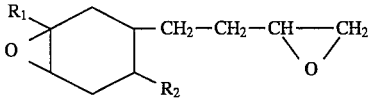

-continued

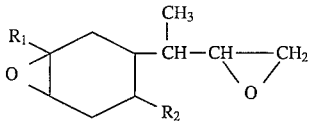

(wherein $R_1$ and $R_2$ independently represent the same meaning as $R_1$ and $R_2$ above).

The addition amount of the alicyclic epoxy compound to be used in the present invention is satisfactory with in a range of 0.05 to 15 parts, preferably 0.5 to 10 parts, and more preferably 0.5 to 5 parts by weight to 100 parts by weight of a synthetic refrigerator base oil. If the addition amount is less than the amount described above, no sufficient effect can be obtained; if the addition amount exceeds the amount described above, the effect of the addition is not very enhanced, but on the contrary, such addition amount induces polymerization, causing sludge.

Furthermore, no specific limitation is imposed to the synthetic oil to be used in the present invention as long as the oil has good compatibility with chlorine-free Flon-type coolants such as Flon 134a and tne like whose molecules do not contain chlorine, but preferably, the synthetic oil is satisfactory if it is practically compatible with the chlorine-free Flon-type coolants such as Flon 134a and the like whose molecules do not contain chlorine, in range of −30° C. to 50° C. and also has a kinematic viscosity of 2 to 50 cSt. For example, polyoxyalkylene glycol and the modified products thereof, neopentyl polyol ester, dibasic acid ester, polyester, fluorinated oil, and the like, can be used as such oil, and they may be used in a mixture of one or more of them.

For specific explanation of these synthetic oils, polyoxyalkylene glycol may be illustrated by such as polyoxypropylene glycol, polyoxyethylene glycol, polyoxyethylene polyoxypropylene glycol, and the like, preferably having a molecular weight of 200 to 3,000. The oxyethylene group and oxypropylene group in polyoxyethylene polyoxypropylene glycol may be in random or block form.

For the modified product of polyoxyalkylene glycol, there may be used the alkylene oxide adduct of polyoxyalkylene glycol monoalkyl ether, polyoxyalkylene glycol dialkyl ether, polyoxyalkylene glycol monoester, polyoxyalkylene glycol diester alkylene diamine, and the like, specifically including the ether of a linear or branched alkyl group having 1 to 18 carbon atoms with the polyoxyalkylene glycol, the ether of an aliphatic carboxylic acid having 2 to 18 atoms with the above glycol, the propylene oxide adduct, ethylene oxide adduct, ethylene oxide propylene oxide random adduct and ethylene oxide propylene oxide block adduct of ethylene diamine, diethylene triamine adduct, and triethylene tetramine, and the like; furthermore, the modified product of the polyoxyalkylene glycol includes polyoxyalkylene glycol glycerol triether, and the halogenated product of polyoxyalkylene glycol (the chlorinated product thereof, in particular, may be satisfactory).

As neopentyl polyol ester, preference is given to ester of neopentyl polyol with an aliphtic carboxylic acid having 2 to 18, preferably 2 to 9 carbon atoms, particularly to the esters of trimethylol propane, pentaerythritol, dipentaerythritol, and tripentaerythritol.

As dibasic acid ester, preference is given to the ester of a divalent carboxylic acid having 4 to 12 carbon atoms with a primary or secondary alcohol having 4 to 18 carbon atoms, specifically including butyl phthalate, dihexyl phthalate and the like.

Such polyester includes the compounds disclosed in Japanese Patent Laid-Open Nos. 3-12899, 3-28992 and the like, for example, the polyester comprising dihydric alcohol having 5 to 12 carbon atoms and/or a polyhydric alcohol such as tri- or higher hydric alcohol having 15 or less carbon atoms and a monohydric fatty acid having 2 to 8 carbon atoms and/or a polybasic asid having 4 to 4 carbon atoms.

The fluorinated oil includes perfluoroether and the like, described in Japanese Patent Laid-Open No.3-7798.

The lubricant for refrigerators in accordance with the present invention does not prohibit the combination thereof with other epoxy compounds.

The lubricant for refrigerators in accordance with the present invention may be used with extreme pressure agents such as tricresyl phosphate and antioxidants such as a-naphthylbenzylamine, phenothiazine, BHT and the like, in a range of the general addition amount.

The lubricant for refrigerators of the present invention is completely compatible with a chlorine-free Flon-type coolants (for example, Flon 34a and the like), at practically any ratio from 1:99 to 99:1, from −50° C. to 60° C.

DESCRIPTION OF PREFERRED EMBODIMENTS

The present invention will now be explained in detail in the following examples, but the invention is not to be limited thereby. In the embodiments, Samples 1 to 6 as additives and Samples 7 and 8 as base oil were employed as shown below.

Sample 1

Epoxy compound represented by the following formula:

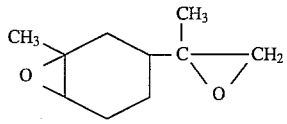

Sample 2

Epoxy compound represented by the following formula:

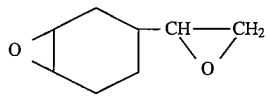

Sample 3

Epoxy compound represented by the following formula:

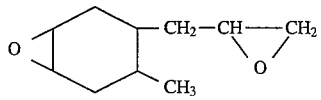

Sample 4

Epoxy compound represented by the following formula:

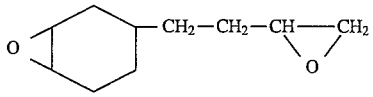

Sample 5

Phenylglycidyl ether

Sample 6

Epoxylated soy bean oil

Sample 7

Polypropylene glycol diacetate represented by the following formula:

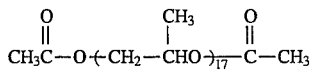

(Kinematic viscosity is 9.8 cSt at 100° C.)

Sample 8

Full ester of a mixture of 2-methylbutanoic acid and hexanoic acid (molar ratio=1:1) and pentaerythritol (kinematic viscisity is 4.2 cSt at 100° C.).

EXAMPLE 1 AND COMPARATIVE EXAMPLE 1

15 parts by weight of each of the lubricants for refrigerator shown in Table 1 and 85 parts by weight of Flon 134a were charged to determine compatibility at −50° to 60° C. As shown in Table 1, the results indicate that the products of the invention show excellent compatibility with Flon 134a.

TABLE 1

| Sample No. of base oil | Sample No. of additives | Compounded amount of additives of base oil (%) | Temperature when turning opaque with Flon 134a |
|---|---|---|---|
| Invention product | | | |
| 7 | 1 | 3 | Complete dissolved |
| 7 | 2 | 3 | Complete dissolved |
| 7 | 3 | 3 | Complete dissolved |
| 7 | 4 | 3 | Complete dissolved |
| 8 | 1 | 3 | Complete dissolved |
| 8 | 2 | 3 | Complete dissolved |
| 8 | 3 | 3 | Complete dissolved |
| 8 | 4 | 3 | Complete dissolved |
| Comparative product | | | |
| 7 | 6 | 3 | Opaque in the entire temperature range |
| 8 | 6 | 3 | Opaque in the entire temperature range |
| 7 | 5 | 3 | Complete dissolved |
| 8 | 5 | 3 | Complete dissolved |

EXAMPLE 2 AND COMPARATIVE EXAMPLE 2

With the organic acids shown in Table 2, Samples 7 and 8 were adjusted to the acid values as shown in Table 2, and were then individually divided at 200 g in 300-ml beakers, followed by addition of 2 g of additives and agitation under heating at 60° C. The samples were collected over time to measure the acid values. The results are shown in Table 2. As clearly shown in Table 2, the invention products reduced the acid values rapidly. The initial acid values of Samples 7 and 8 were individually 0.01 and 0.02.

TABLE 2

| Sample No. of base oil | Organic acid | Sample No. of additives | Acid value adjusted (mg · KOH/g) | Acid value after addition of additives (mg · KOH/g) 2 hrs later | 4 hrs later | 8 hrs later |
|---|---|---|---|---|---|---|
| Invention product | | | | | | |
| 7 | Ace. | 1 | 0.52 | 0.23 | 0.10 | 0.03 |
| 7 | Ace. | 2 | 0.52 | 0.17 | 0.08 | 0.02 |
| 8 | Hexa. | 1 | 0.68 | 0.26 | 0.13 | 0.05 |
| 8 | Hexa. | 2 | 0.68 | 0.21 | 0.09 | 0.03 |
| 8 | Hexa. | 3 | 0.68 | 0.28 | 0.10 | 0.05 |
| 8 | Hexa. | 4 | 0.68 | 0.25 | 0.11 | 0.07 |
| 8 | Hexa. | 1 | 2.34 | 0.86 | 0.36 | 0.18 |
| 8 | Hexa. | 2 | 2.34 | 0.52 | 0.21 | 0.11 |
| Comparative product | | | | | | |
| 7 | Ace. | 5 | 0.52 | 0.45 | 0.31 | 0.24 |
| 8 | Hexa. | 5 | 0.68 | 0.55 | 0.42 | 0.35 |
| 8 | Hexa. | 5 | 2.34 | 2.05 | 1.70 | 1.27 |

Ace. = acetic acid;
Hexa. = hexanoic acid

EXAMPLE 3 AND COMPARATIVE EXAMPLE 3

To the individual oil compositions for refrigerators shown in Table 3 was added 1000 ppm of water. 20 parts by weight of the individual resulting mixtures and 80 parts by weight of Flon 134a were then placed in a 100-ml stainless-steel (SUS-316) autoclave, followed by addition of a piece of steel, copper and aluminium (50×50×1.5 mm) prior to sealing. Subsequently, heating was done at 150° C. for 14 days (336 hours). After the termination of the heating test, degassing to vacuum to remove Flon 134a and water was done to evaluate the kinematic viscosity, appearance and acid value of the oil compositions for refrigerator after the testing. The metal pieces were washed in toluene and methanol, to measure the increase or decrease of the weight thereof. All of the results are shown in Table 4.

TABLE 3

| Oil for refrigerators | Sample No. of base oil | Sample No. of additives | Compounded amount of additives of base oil (%) |
|---|---|---|---|
| 1 | 7 | 1 | 2 |
| 2 | 7 | 2 | 2 |
| 3 | 7 | 3 | 2 |
| 4 | 7 | 4 | 2 |
| 5 | 8 | 1 | 1 |
| 6 | 8 | 1 | 3 |
| 7 | 8 | 1 | 5 |
| 8 | 8 | 2 | 0.3 |
| 9 | 8 | 2 | 3 |
| 10 | 8 | 2 | 7.5 |
| 11 | 7 | | |
| 12 | 8 | | |

TABLE 4

| Oil for refrigerators No. | Kinematic viscosity at 100° C. (cSt) before test | after test | Variation of viscosity (%) | Appearance (Gardner's chromaticity) before test | after test | Acid value (mg · KOH/g) before test | after test | Variation of weight metal piece (mg/cm²) steel | cooper | aluminium |
|---|---|---|---|---|---|---|---|---|---|---|
| Invention product | | | | | | | | | | |
| 1 | 52 | 52 | 0 | pale yellow, transparent (1) | pale yellow, transparent (1) | 0.01 | 0.01 | ±0 | ±0 | ±0 |
| 2 | 51 | 51 | 0 | pale yellow, transparent (1) | pale yellow, transparent (1) | 0.01 | 0.00 | ±0 | ±0 | ±0 |
| 3 | 52 | 52 | 0 | pale yellow, transparent (1) | pale yellow, transparent (1) | 0.01 | 0.01 | ±0 | ±0 | ±0 |
| 4 | 52 | 52 | 0 | pale yellow, transparent (1) | pale yellow, transparent (1) | 0.01 | 0.01 | ±0 | ±0 | ±0 |
| 5 | 20 | 20 | 0 | pale yellow, transparent (2) | pale yellow, transparent (2) | 0.02 | 0.01 | ±0 | ±0 | ±0 |
| 6 | 20 | 20 | 0 | pale yellow, transparent (2) | pale yellow, transparent (2) | 0.02 | 0.00 | ±0 | ±0 | ±0 |
| 7 | 19 | 19 | 0 | pale yellow, transparent (2) | pale yellow, transparent (2) | 0.02 | 0.01 | ±0 | ±0 | ±0 |
| 8 | 20 | 20 | 0 | pale yellow, transparent (2) | pale yellow, transparent (2) | 0.02 | 0.58 | ±0 | ±0 | ±0 |
| 9 | 19 | 19 | 0 | pale yellow, transparent (2) | pale yellow, transparent (2) | 0.02 | 0.01 | ±0 | ±0 | ±0 |
| 10 | 17 | 17 | 0 | pale yellow, transparent (2) | pale yellow, transparent (2) | 0.02 | 0.01 | ±0 | ±0 | ±0 |
| Comparative product | | | | | | | | | | |
| 11 | 52 | 48 | −7.6 | pale yellow, transparent (2) | dark brown, transparent (7) | 0.01 | 2.82 | −0.3 | −0.4 | −0.1 |
| 12 | 20 | 22 | 10 | pale yellow, transparent (2) | dark brown, transparent (8) | 0.02 | 2.14 | −0.2 | −0.4 | −0.1 |

The advantage of the present invention resides in providing a lubricant for refrigerators, reacting rapidly with free acids and containing a stabilizer with good compatibility with a chlorine-free Flon-type coolant such as Flon 134a and the like.

That is, the lubricant for refrigerators in accordance with the present invention has the following advantages:

1. No trouble in vaporizers because of the good compatibility with Flon 134a and the like in refrigerators;
2. Rapid reaction with free acids, oxides and other active groups generated in refrigerators to prevent corrosion, and the like.

What is claimed is:

1. A refrigerant composition comprising (a) an acid ester synthetic oil selected from the group consisting neopentyl polyol esters and dibasic acid esters, (b) an alicyclic epoxy compound represented by the following formula:

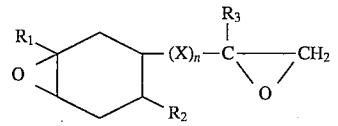

wherein $R_1$, $R_2$ and $R_3$ each independently represent a group selected from the class consisting of hydrogen and methyl, X represents a group selected from the class consisting of —$CH_2$—, —$CH_2CH_2$—and —$CH(CH_3)$—, and n is an integer of 0 or 1, and (c) a chlorine-free fluorinated hydrocarbon coolant, there being from 0.05 to 15 parts by weight of said alicyclic epoxy compound for each 100 parts by weight of said oil, and the weight ratio of the combined weight of said oil and said alicyclic epoxy compound to said coolant being from 1:99 to 99:1.

2. The composition of claim 1 wherein said alicyclic epoxy compound is selected from the group consisting of the following compounds:

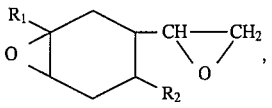

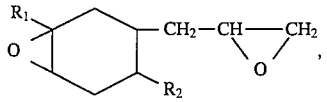

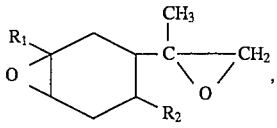

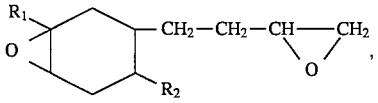

and

-continued

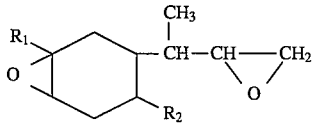

wherein $R_1$, and $R_2$ are each as above defined.

3. The composition of claim 1 wherein said coolant is 1,1,2,2-tetrafluoroethane.

4. The composition of claim 1 wherein said oil is a neopentyl polyol ester.

5. The composition of claim 4 wherein said neopentyl polyol ester is a full ester of 1:1 molar ratio mixture of 2-methylbutanoic acid and hexanoic acid with pentaerythritol.

6. The refrigerant composition of claim 1 wherein said acid ester synthetic oil is an ester of pentaerythritol with at least one aliphatic carboxylic acid having 2 to 9 carbon atoms per molecule.

7. The refrigerant composition of claim 1 wherein said acid ester synthetic oil is a polypropylene glycol diacetate represented by the formula:

$$CH_3\overset{\overset{\displaystyle O}{\|}}{C}-O-(CH_2\overset{\overset{\displaystyle CH_3}{|}}{C}HO)_{17}-\overset{\overset{\displaystyle O}{\|}}{C}-CH_3.$$

* * * * *